US008251468B2

(12) United States Patent
Yuen

(10) Patent No.: US 8,251,468 B2
(45) Date of Patent: Aug. 28, 2012

(54) INK REFILL KIT

(75) Inventor: Kenneth Yuen, San Gabriel, CA (US)

(73) Assignee: Master Ink Company, Ltd., Kwun Tong (HK)

( * ) Notice: Subject to any disclaimer, the term of this patent is extended or adjusted under 35 U.S.C. 154(b) by 336 days.

(21) Appl. No.: 12/504,557

(22) Filed: Jul. 16, 2009

(65) Prior Publication Data

US 2011/0012944 A1 Jan. 20, 2011

(51) Int. Cl.
*B41J 2/195* (2006.01)
*B41J 2/17* (2006.01)
*B41J 2/175* (2006.01)

(52) U.S. Cl. ..... 347/7; 347/84; 347/85; 347/86

(58) Field of Classification Search ..... 347/6, 84–86, 347/7

See application file for complete search history.

(56) References Cited

U.S. PATENT DOCUMENTS

| | | | |
|---|---|---|---|
| 6,347,863 | B1 | 2/2002 | Yuen |
| 6,799,610 | B2 | 10/2004 | Yuen |
| 6,971,740 | B2 | 12/2005 | Yuen |
| 7,303,267 | B2 | 12/2007 | Yuen |
| 7,325,909 | B2 | 2/2008 | Yuen |

OTHER PUBLICATIONS

"Instructions for Refilling HP Color Cartridges," Dataproducts USA, LLC, 2007, 1 page.

*Primary Examiner* — Jason Uhlenhake
(74) *Attorney, Agent, or Firm* — Merchant & Gould P.C.

(57) ABSTRACT

The present disclosure provides a compact and easy-to-use ink refill device that is configured to refill empty ink cartridges. The device includes an ink reservoir that stores ink, a cartridge holder that secures the cartridge during refilling, and an ink delivery system that allows ink to flow from the ink reservoir to the spent cartridge. The ink delivery system is configured to avoid ink from leaking from the reservoir before, during, and after refilling. The ink delivery system of the present disclosure is also configured to avoid overfilling or under filling.

19 Claims, 10 Drawing Sheets

INK REFILL KIT

TECHNICAL FIELD

The present disclosure relates to a device for refilling ink cartridges and related methods of ink cartridge refilling.

BACKGROUND

Ink cartridges are commonly discarded and replaced when empty. More recently, devices and methods have been developed to refill spent ink cartridges. Such devices and methods are desirable as they are environmentally friendly and save cost. Improved refilling devices and methods are desirable.

SUMMARY

The present disclosure provides a compact and easy-to-use ink refill device that is configured to refill empty ink cartridges. The device includes an ink reservoir that stores ink, a cartridge holder that secures the cartridge during refilling, and an ink delivery system that allows ink to flow from the ink reservoir to the spent cartridge. The ink delivery system is configured to avoid ink from leaking from the reservoir before, during, and after refilling. The ink delivery system of the present disclosure is also configured to avoid overfilling or under filling.

DETAILED DESCRIPTION

Figure 1:
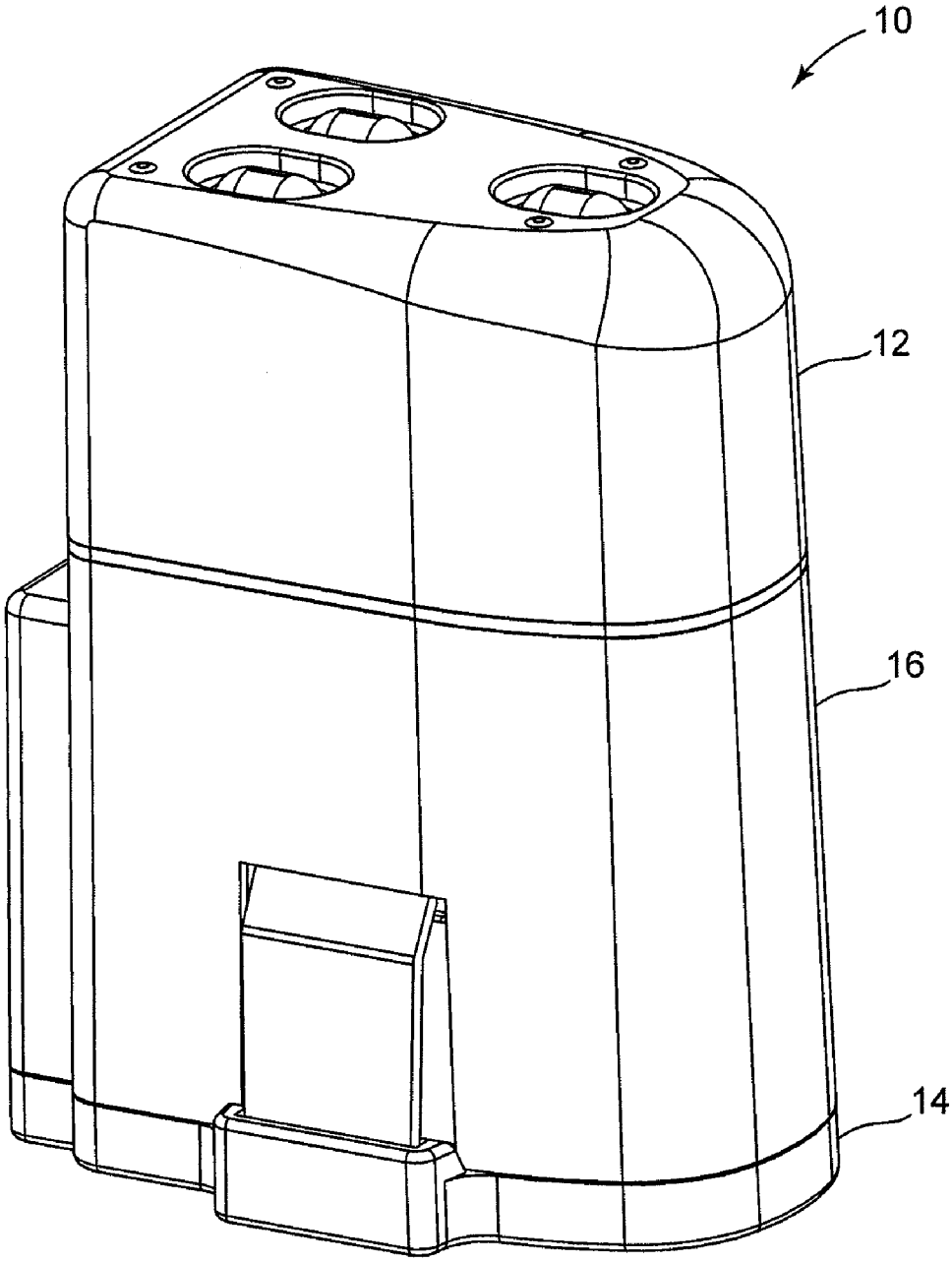
FIG. 1 is a perspective view of an embodiment of the ink refill device according to the principles of the present disclosure.
Figure 2:
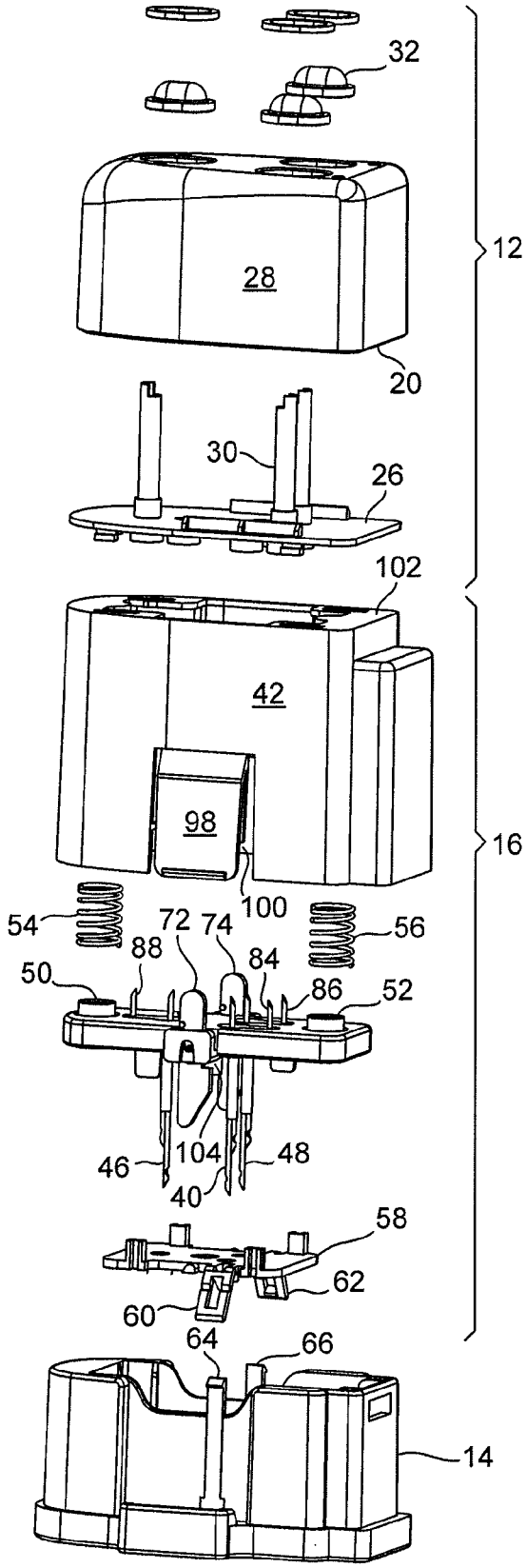
FIG. 2 is an exploded assembly view of the ink refill device of FIG. 1.
Figure 3:
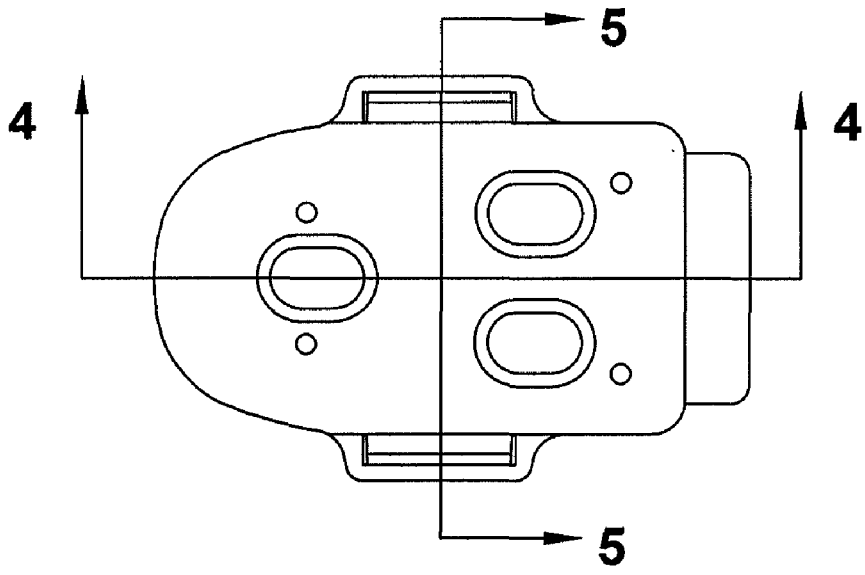
FIG. 3 is a top view of the ink refill device of FIG. 1.
Figure 4:
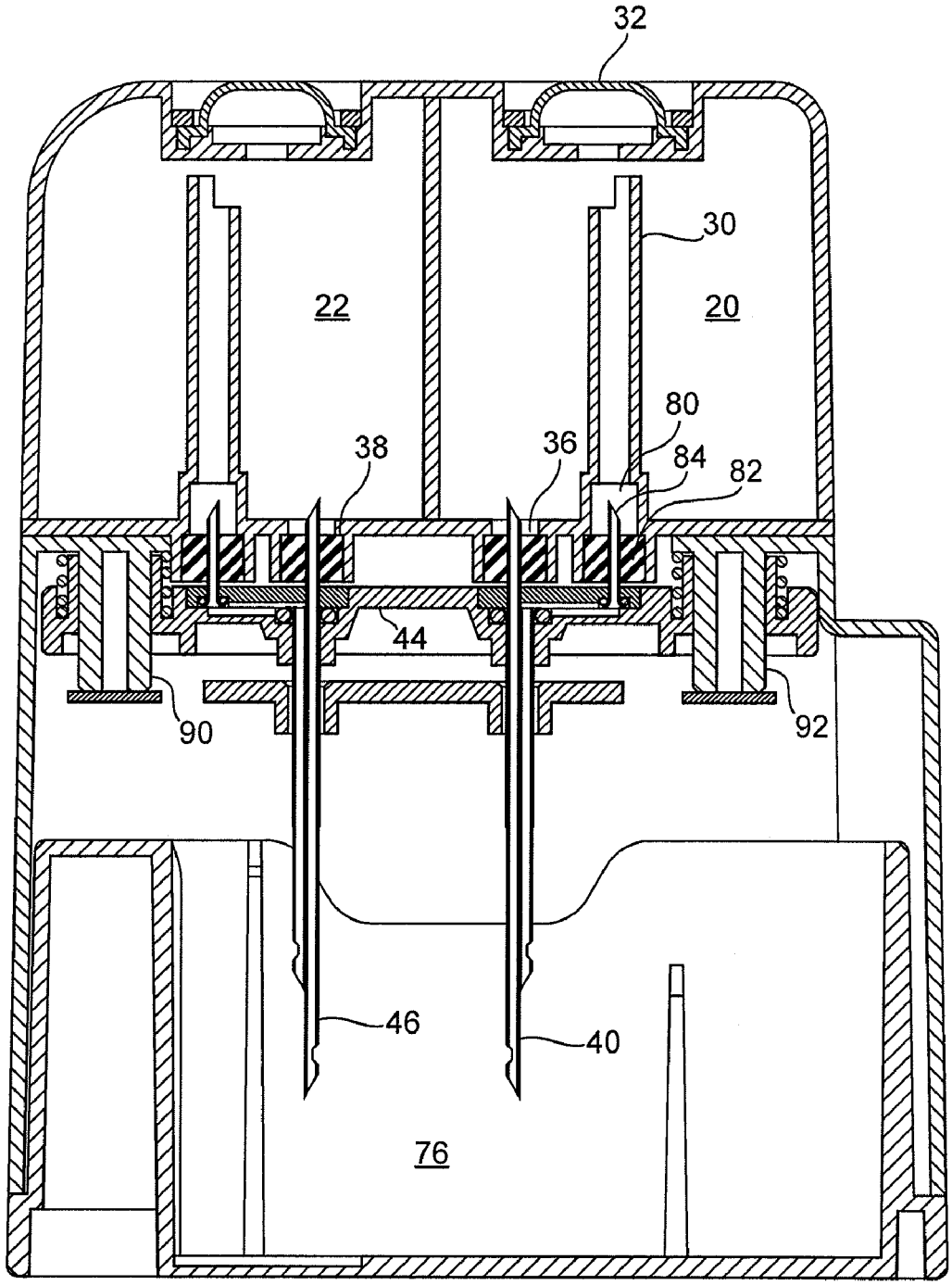
FIG. 4 is a cross-sectional view of the ink refill device of FIG. 1 along line 4-4 of FIG. 3.
Figure 5:
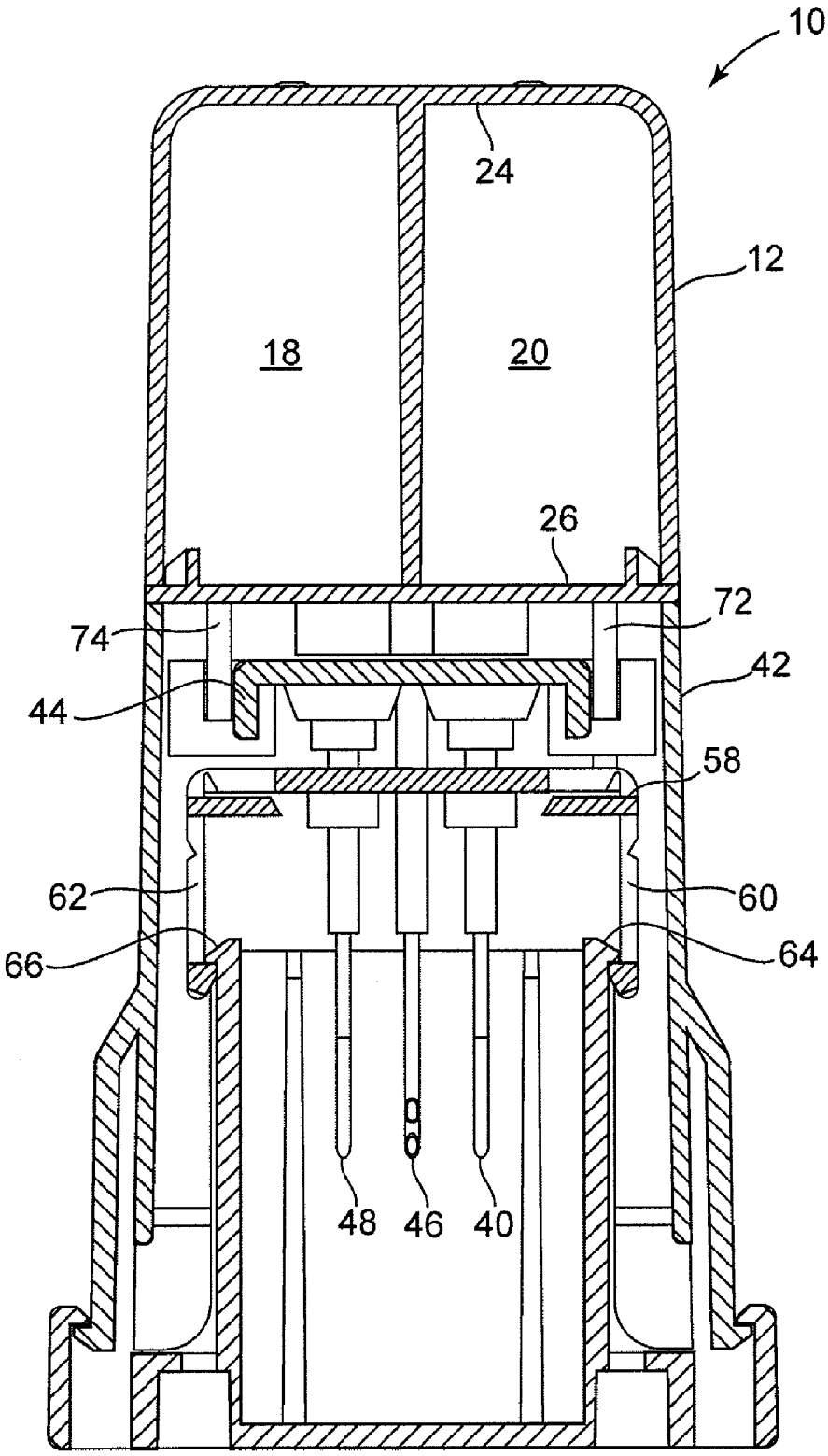
FIG. 5 is a cross-sectional view of the ink refill device of FIG. 1 along line 5-5 of FIG. 3.
Figure 6A:
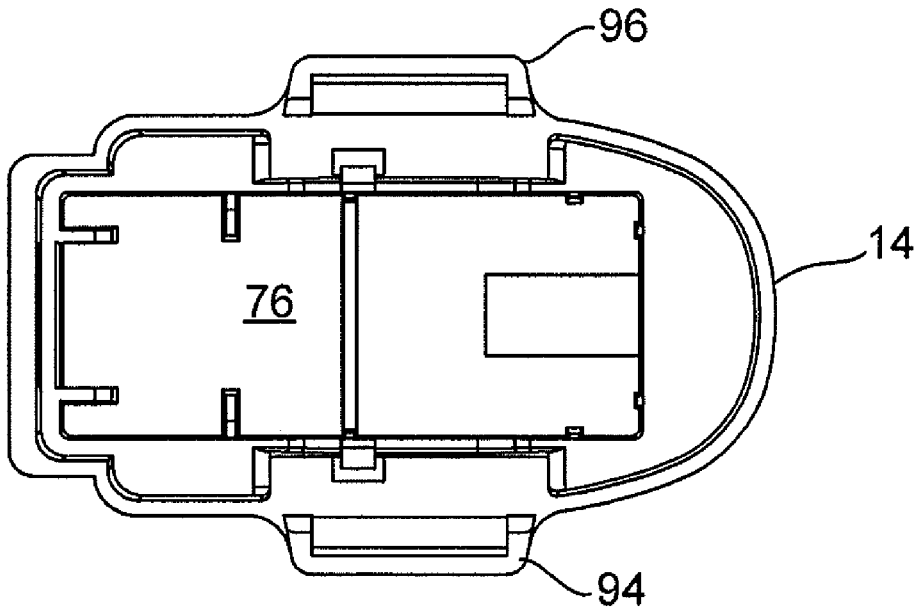
FIG. 6A is a top view of an ink cartridge holder of the ink refill device of FIG. 1.
Figure 6B:
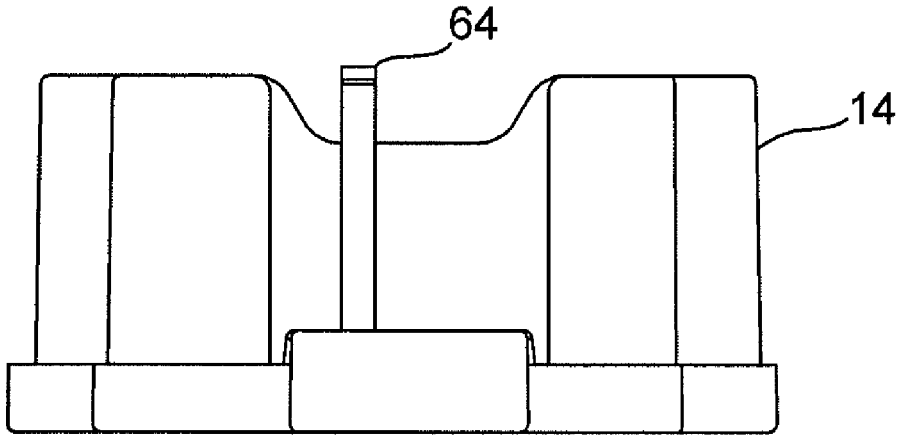
FIG. 6B is a side view of an ink cartridge holder of the ink refill device of FIG. 1.
Figure 7:
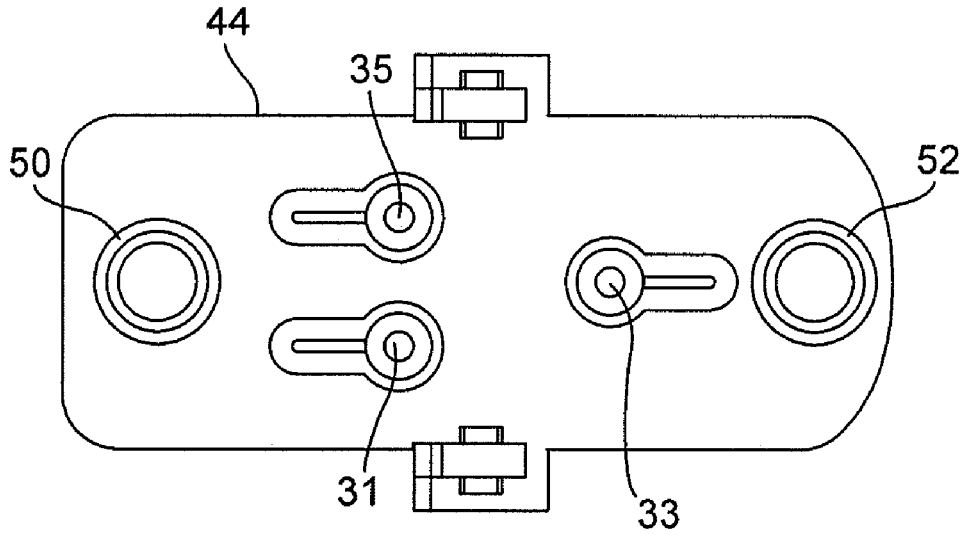
FIG. 7 is a top view of a support member of the ink refill device of FIG. 1.
Figure 8:
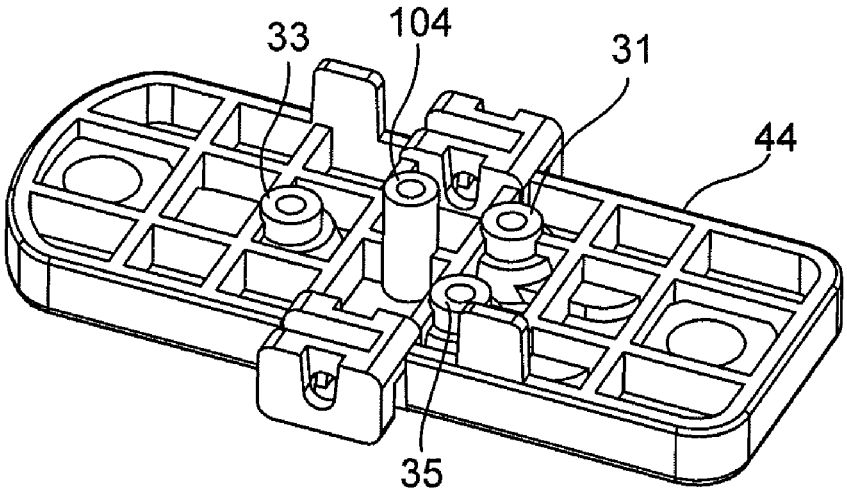
FIG. 8 is a bottom perspective view of the support member of FIG. 7.
Figure 9:
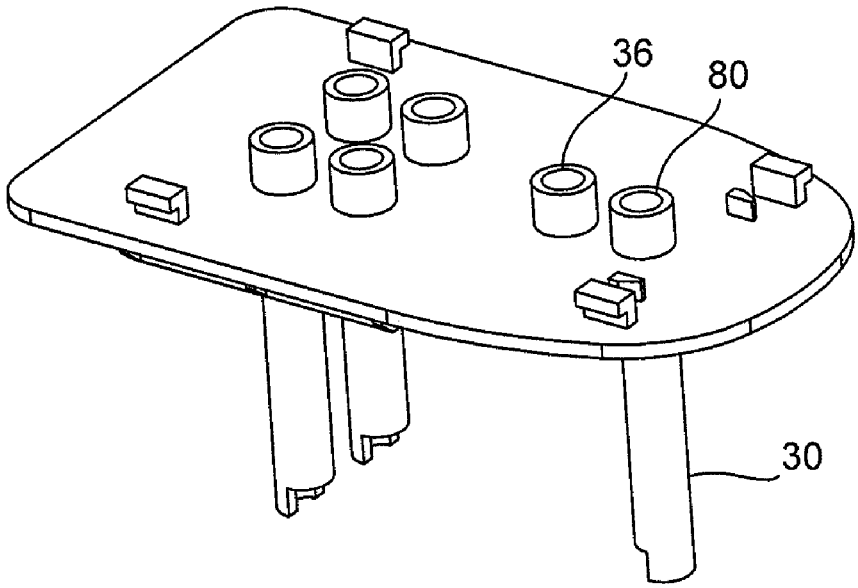
FIG. 9 is a bottom perspective view of a bottom wall of an ink reservoir of the ink refill device of FIG. 1.
Figure 10:
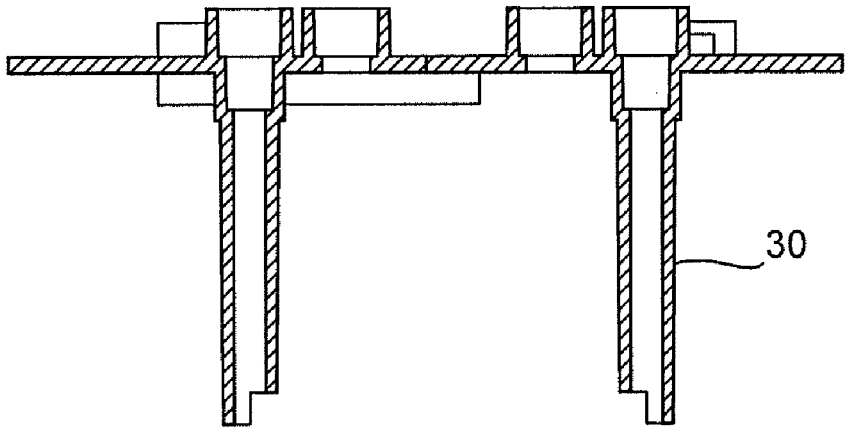
FIG. 10 is a longitudinal cross-sectional view of the bottom wall of the reservoir of the ink refill device of FIG. 1.
Figure 11:
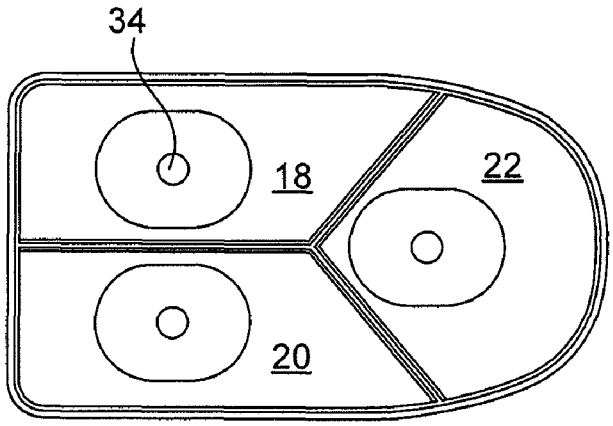
FIG. 11 is a top view of the ink reservoir of the ink refilling device of FIG. 1.
Figure 12:
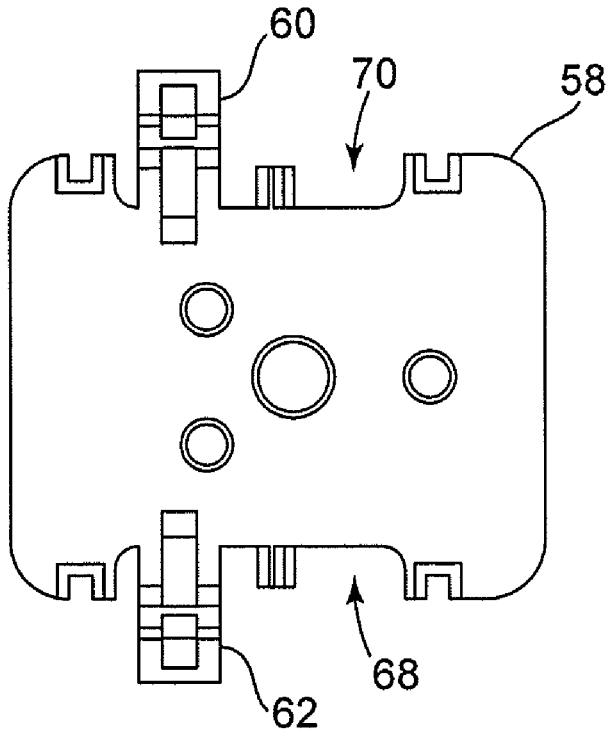
FIG. 12 is a top view of a guard of the ink refilling device of FIG. 1.
Figure 13:
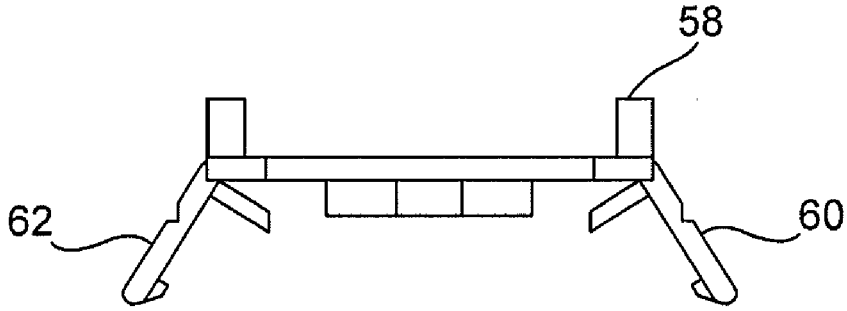
FIG. 13 is a side view of the guard of FIG. 12.

Referring to FIGS. 1-13 an embodiment of the ink refill device according to the principles of the present disclosure is described. The ink refill device 10 includes an ink reservoir 12 for storing the ink, an ink cartridge holder 14 for supporting a cartridge during the refilling process, and an ink delivery assembly 16 for delivering the ink from the ink reservoir 12 to the cartridge.

In the depicted embodiment, the ink refill device 10 is configured so that the ink cartridge holder 14 is separable from the other portions of the ink refill device 10 for convenient loading and unloading of ink cartridges. Once an empty ink cartridge is loaded into the cartridge holder 14, the cartridge holder and ink delivery assembly 16 are manually moved into engagement with each other. The action of moving the ink delivery assembly 16 towards the cartridge holder 14 forces ink needles 40, 46, 48 of the ink delivery assembly 16 into both the ink cartridge (not shown) and the ink reservoir 12. After the ink cartridge is filled, the ink reservoir 12 is moved away from the cartridge holder 14, thereby separating cartridge holder 14 from the other portions of the ink refilling device 10. The action of moving the ink reservoir 12 away from the ink cartridge holder 14 disengages the ink needles 40, 46, 48 from both the ink reservoir 12 and the ink cartridge. It should be appreciated that many alternative embodiments exist. For example, the ink cartridge holder 14 in an alternative embodiment may not be separable from the other portions of the ink refilling device.

In the depicted embodiment the ink reservoir 12 is located at the upper end of the ink refill device 10. The ink reservoir 12 includes multiple ink compartments 18, 20, 22, also referred to herein interchangeably as ink chambers. In the depicted embodiment, each of the ink compartments 18, 20, 22 are for housing different color inks, and include similar features which are described below with reference to ink compartment 20. It should be appreciated that in other embodiments, the ink reservoir 12 can be configured differently. For example, a refilling device configured to refill black ink cartridges may include a single ink chamber rather than multiple ink chambers.

In the depicted embodiment, ink compartment 20 includes a top wall 24, a bottom wall 26, and a side wall 28. Ink compartment 20 also includes a vent tube 30 that extends from a bottom wall 26 of the ink compartment 20 to an inner upper portion of the ink chamber. The vent tube 30 facilities ink flow by allowing air to flow into the ink compartment 20 as the ink within the ink compartment flows from the ink compartment into the ink cartridge. In the depicted embodiment the top wall 24, bottom wall 26, and portions of the side wall 28 of each ink compartment 18, 20, 22 are of a continuous piece of plastic material. In the depicted embodiment the bottom wall 26 is formed integral with vent tube 30 and ink needle receiving apertures 31, 33, 35. It should be appreciated that many alternative configurations are also possible.

In the depicted embodiment, ink compartment 20 also includes a pump arrangement that includes a diaphragm pump 32 located over an aperture 34 in the top wall 24 of the compartment. The diaphragm pump 32 is configured such that manually depressing the diaphragm pump 32 facilitates ink flow by changing the pressure in the compartment, thereby overcoming the surface tension of the ink in the ink compartment 20.

In the depicted embodiment the bottom wall 26 of the ink compartment 20 includes an aperture 36 that receives a sealing member 38 (e.g., rubber plug). The sealing member 38 is configured to receive an ink delivery needle 40 from the ink delivery assembly 16, thereby enabling ink flow from the ink compartment 20 through the ink delivery needle 40 into the ink cartridge. The sealing member 38 is configured to limit the ink flow out of the ink compartment 20, when the ink delivery needle 40 is retracted out of the ink compartment 20. The sealing member 38 prevents ink leakage before, during, and after refilling.

In the depicted embodiment the bottom wall 26 of the ink compartment includes an aperture 80 that is in fluid communication with the vent tube 30. The aperture 80 is configured to receive a sealing member 82 that seals the aperture 80 to prevent ink from flowing out of the ink compartment 20 through the vent tube 30. In the depicted embodiment, the sealing member 82 is configured to receive a vent post 84 that extends through the sealing member 82 into the vent tube 30 during the ink refilling process. The vent post 84 allows air to flow into the ink compartment 20 as the ink drains from the compartment during the refilling of an ink cartridge. It should be appreciated that many alternative embodiments are possible. For example, in some alternative embodiments of the ink refill device, the vent tubes 30 are configured such that the sealing member 82 and vent post 84 are eliminated.

In the depicted embodiment the ink delivery assembly 16 interfaces between the ink reservoir 12 and the cartridge holder 14. The ink delivery assembly 16 includes a housing 42 with an upper end connected to the bottom wall 26 of the ink reservoir 12, and a lower end that is open and configured to slidably receive the ink cartridge holder 14. In the depicted embodiment, the ink delivery assembly includes a support member 44 within the housing 42. The support member 44 supports a number of ink delivery needles 40, 46, 48 and vent posts 84, 86, 88 and is configured to slide towards and away from the ink reservoir 12. In the depicted embodiment, the support member includes apertures 50, 52 that receive posts 90, 92 that extend from the top surface 102 of the housing 42. Springs 54, 56 are located around the posts so that the support member 44 is normally biased away from the ink reservoir 12. It should be appreciated that many other alternative configurations are also possible.

When the support member 44 is moved to a first position near the ink reservoir 12 (raised position), the ink delivery needles 40, 46, 48 are in fluid communication with the inner cavity of the ink compartments 18, 20, 22. In the raised position, vent posts 84, 86, 88 are also moved into the vent tubes. When the support member 44 is moved to a second position farther from the ink reservoir 12 (lower position), the ink delivery needles 40, 46, 48 pulled out from the inner cavity of the ink compartments 18, 20, 22. In the lower position, the vent posts 84, 86, 88 are retracted out from the vent tubes. In the depicted embodiment, the ink delivery needles 40, 46, 48 enter the ink reservoir 12 at a different location than the vent posts 84, 86, 88. It should be appreciated that other configurations are also possible.

In the depicted embodiment a post 104 extends from the bottom surface of the support member 44 and is configured to engage the top surface of an ink cartridge as the ink reservoir 12 moves towards the ink cartridge holder 14, thereby pushing the support member from the second position into the first position. If the ink reservoir 12 is moved toward the ink cartridge holder 14 when no ink cartridge is in the cartridge holder 14, the support member 44 does not move into a raised position, which avoids unintentional draining of the ink reservoir 12.

In the depicted embodiment, the ink delivery assembly 16 includes a guard 58 located within the housing 42 between the support member 44 and the cartridge holder 14. The guard 58 is configured to slide upwardly and downwardly relative to the ink delivery needles 40, 46, 48. In the downward most position the guard 58 extends pass and covers the lower ends of the ink delivery needles 40, 46, 48, thereby preventing a user from inadvertently contacting the ink needles 40, 46, 48. In the depicted embodiment the guard 58 presses up against the support member 44 when the ink cartridge holder 14 is pushed into the housing 42 of the ink delivery assembly 16 (see FIG. 4). This action causes the ink delivery needles 40, 46, 48 to enter into the ink compartments 18, 20, 22. When the ink cartridge holder 14 is pulled away from the ink reservoir 12, the guard 58 moves downwardly with the ink cartridge holder 14, and causes the support member 44 to move downward, which retracts the ink needles 40, 46, 48 from the ink reservoir.

In the depicted embodiment, the guard plate 58 is configured to move downward with the cartridge holder 14. In particular, the guard plate 58 includes a pair of pivot latches 60, 62 that grab onto catches 64, 66 on the cartridge holder 14 when the holder is in the housing 42. In the depicted embodiment, the pivot latches 60, 62 engage the inside side surface of the housing 42 such that the pivot latches 60, 62 remain engaged with the cartridge holder 14 when the cartridge holder 14 is within the housing 42. When the cartridge holder 14 is pulled away, the pivot latches disengage with the inside side surface of the housing and release the catches 64, 66 automatically.

In the depicted embodiment, the guard 58 includes openings 68, 70 that receive pivot levers 72, 74 that are connected to the support member 44. In the depicted embodiment, when the support member 44 is in the lower position (i.e., when the ink needles 40, 46, 48 and vent post 84, 86, 88 are disengaged from the ink reservoir 12), the pivot levers 72, 74 are generally vertical. When the pivot levers 72, 74 are in the vertical position, the needles 40, 46, 48 are prevented from entering into the ink reservoir as the upward movement of the support member 44 is limited by the pivot levers 72, 74. The pivot levers 72, 74 are configured and arranged to avoid the needles 40, 46, 48 from inadvertently entering the ink reservoir 12. In normal use the pivot levers 72, 74 slide into the openings 68, 70 as the guard 58 is raised. As the guard 58 moves towards the ink reservoir 12, the pivot levers 72, 74 are pivoted off in one direction, thereby allowing the support member 44 to move upwards, which results in the needles 40, 46, 48 entering the ink reservoir 12. Conversely, as the guard 58 moves downwardly, the guard 58 pulls the pivot levers 72, 74 into a generally vertical orientation. The pivot levers 72, 74 can also assist the spring 54, 56 in biasing the support member 44 away from the ink reservoir 12. It should be appreciated that many alternative embodiments are also possible.

In the depicted embodiment, the cartridge holder 14 includes a body portion having a cavity 76 for supporting an ink cartridge. The catches 64, 66 extend upward from the sides of the body portion. The sides of the body portion have outside surfaces that are shaped to slide within the housing 42 to align the cartridge with the ink delivery needles 40, 46, 48. The cartridge holder 14 includes a side aperture 94, 96 that engage arm members 98, 100 of the housing 42 when the cartridge holder 14 is fully inserted into the housing 42. In the depicted embodiment the arms 98, 100 deflect and snap into engagement with the side apertures 94, 96. It should be appreciated that many alternative configurations are possible.

In the depicted embodiment, a method of refilling an ink cartridge is disclosed that involves pushing ink reservoir 12 towards a cartridge holder 14, thereby moving ink delivery needles 40, 46, 48 of an ink delivery assembly 16 into the ink reservoir 12. In the depicted embodiment, moving the cartridge holder towards the ink reservoir 12 first pushes the ink delivery needles 40, 46, 48 into the spent ink cartridge and then pushes the ink delivery needles 40, 46, 48 into the ink reservoir 12. In the depicted embodiment, the step of pulling the ink reservoir 12 away from the cartridge holder 14 moves the ink delivery needles from the ink reservoir 12 and then separating the now refilled spent ink cartridge from the ink delivery needles. In the depicted embodiment a guard plate 58 automatically engages and disengages from the ink cartridge holder 14 depending on the position of the ink cartridge holder 14 relative to the ink reservoir 12. The guard plate 58 is configured to push the support member 44 toward the ink reservoir and pull the support member away from the ink reservoir 12 depending on the position and movement of the cartridge holder 14.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An ink refill device comprising:

an ink reservoir including multiple ink compartments;

an ink cartridge holder;

an ink delivery assembly configured to deliver ink from the ink reservoir to an ink cartridge engaged with the ink cartridge holder, the ink delivery assembly including:

a support member that is configured to move towards and away from the ink reservoir;

a needle connected to the support member configured to move into the ink reservoir when the support member moves towards the ink reservoir;

wherein the support member moves towards the ink reservoir when the ink reservoir is moved towards the ink cartridge holder;

wherein the ink needle is configured to first move into an ink cartridge in the ink cartridge holder and then subsequently move into the ink reservoir when the ink reservoir is moved towards the ink cartridge holder.

2. The ink refilling device of claim 1, wherein the ink needle is arranged such that it moves out of the ink reservoir when the ink reservoir is moved away from the ink cartridge holder.

3. The ink refilling device of claim 1, wherein the ink needle is configured to move into an ink cartridge in the ink cartridge holder and into the ink reservoir when the ink reservoir is moved towards the ink cartridge holder.

4. The ink refilling device of claim 1, wherein the ink reservoir including at least two separate ink chambers, each ink chamber including:

a top wall, a bottom wall, and a side wall;

a vent tube that extends from a bottom wall of the ink reservoir to an inner upper portion of the ink chamber, a diaphragm pump for initiating ink flow out of the chamber located on the top wall, a lower needle receiving aperture at a bottom portion of the chamber configured to receive an ink deliver needle; and a sealing device configured to prevent ink from leaving the chamber when the ink delivery needle is not received in the lower needle receiving aperture.

5. The ink refilling device of claim 1, wherein an ink delivery assembly includes:

a housing including side walls, and an open bottom end;

a support member within the housing configured and arranged such that the support member can move towards and away from the bottom wall of the ink reservoir;

at least two ink delivery needles connected to the support member, wherein each needle is aligned with one of the two separate ink chambers of the ink reservoir, wherein the needles are configured to enter into and retract from the ink reservoir via the lower needle receiving aperture; and a guard positioned below the support member and configured to slide upwardly and downwardly relative to the ink delivery needles.

6. The ink refilling device of claim 5, wherein the guard is a plate structure including apertures for slidably receiving the at least two ink delivery needles and side channels for receiving alignment ribs extending from the housing.

7. The ink refilling device of claim 5, further comprising a latching mechanism including pivot arms on the guard that engage catches on the cartridge holder and are pivoted when portions of the pivot arms contact portions of the housing.

8. The ink refilling device of claim 1, wherein cartridge holder is configured to slidably engage the ink delivery assembly, the cartridge holder including:

a body portion configured to be slidably received within the housing of the ink delivery assembly, the body portion including:

a cavity for supporting an ink cartridge; and a latch member that engages a guard.

9. An ink refill device comprising:

an ink reservoir including multiple ink compartments;

an ink cartridge holder;

an ink delivery assembly configured to deliver ink from the ink reservoir to an ink cartridge engaged with the ink cartridge holder, the ink delivery assembly including:

a support member that is configured to move towards and away from the ink reservoir;

a needle connected to the support member configured to move into the ink reservoir when the support member moves towards the ink reservoir;

wherein the support member moves towards the ink reservoir when the ink reservoir is moved towards the ink cartridge holder;

wherein the ink needle is arranged such that it moves out of the ink reservoir when the ink reservoir is moved away from the ink cartridge holder, and wherein the ink needle is configured to first move out of an ink cartridge in the ink cartridge holder then subsequently move out of the ink reservoir when the ink reservoir is moved away from the cartridge holder.

10. An ink refilling device comprising:

(a) an ink reservoir including at least two separate ink chambers, each ink chamber including:

a top wall, a bottom wall, and a side wall;

a vent tube that extends from the bottom wall of the ink reservoir to an inner upper portion of the ink chamber, a diaphragm pump for initiating ink flow out of the chamber located on the top wall, a lower needle receiving aperture at a bottom portion of the chamber configured to receive an ink deliver needle;

a sealing device configured to prevent ink from leaving the chamber when the ink delivery needle is not received in the lower needle receiving aperture;

(b) an ink delivery assembly connected adjacent the bottom portion of the ink reservoir, the ink delivery assembly including:

a housing including side walls, and an open bottom end;

a support member within the housing configured and arranged such that the support member can move towards and away from the bottom wall of the ink reservoir;

at least two ink delivery needles connected to the support member, wherein each needle is aligned with one of the two separate ink chambers of the ink reservoir, wherein the needles are configured to enter into and retract from the ink reservoir via the lower needle receiving aperture;

a guard positioned below the support member and configured to slide upwardly and downwardly relative to the ink delivery needles;

(c) a cartridge holder configured to slidably engage the ink delivery assembly, the cartridge holder including:

a body portion configured to be slidably received within the housing of the ink delivery assembly, the body portion including:

a cavity for supporting an ink cartridge;

a latch member that engages the guard; and further comprising a latching mechanism including pivot arms on the guard that engage catches on the cartridge holder and are pivoted when portions of the pivot arms contact portions of the housing.

11. An ink refilling device of claim 10, further comprising a guide and spring configuration slidably connecting the support member within the housing to a bottom of the ink reservoir such that the support member can move towards or away from the bottom wall of the ink reservoir.

12. An ink refilling device of claim 10, wherein the support member and ink delivery needles are arranged such that when the support member is in a filling position the ink delivery needles are positioned within the ink reservoir, and when the support member is in a normal position the ink delivery needles are positioned outside of the ink reservoir.

13. An ink refilling device of claim 10, wherein the guard is a plate structure including apertures for slidably receiving the at least two ink delivery needles.

14. An ink refilling device of claim 10, at least three vent post that are configured to enter the ink reservoir at a location that are spaced away from the ink delivery needles.

15. A method of refilling an ink cartridge comprising:

pushing an ink reservoir towards a cartridge holder in which a spent ink cartridge is secured, thereby moving ink delivery needles of an ink delivery assembly into the ink reservoir wherein the step of pushing the ink reservoir towards the cartridge holder first pushes the ink delivery needles into the spent ink cartridge and then pushes the ink delivery needles into the ink reservoir.

16. The method of claim 15, wherein the step of pushing the ink reservoir towards the cartridge holder also pushes the ink delivery needles into the spent ink cartridge.

17. The method of claim 15, further comprising the step of pulling the cartridge holder away from the ink reservoir, thereby first moving the ink delivery needles from the ink reservoir and then separating the spent ink cartridge from the ink delivery needles.

18. The method of claim 17, wherein the step of pulling the cartridge holder away from the ink reservoir pulls a guard plate towards the exposed ends of the needles.

19. The method of claim 18, wherein the guide plate is configured to automatically release from the cartridge holder when the cartridge holder is moved a particular distance from the ink reservoir.

* * * * *